United States Patent [19]

Weiss

[11] Patent Number: 4,498,209

[45] Date of Patent: Feb. 12, 1985

[54] TWIN DENTAL BRUSH

[76] Inventor: Leslie Weiss, #354 607 Franklin Ave., Hollywood, Calif. 90028

[21] Appl. No.: 479,001

[22] Filed: Mar. 25, 1983

[51] Int. Cl.[3] ..... A46B 9/04

[52] U.S. Cl. ..... 15/167 A; 15/143 R

[58] Field of Search ..... 15/167 R, 167 A, 110, 15/143 R

[56] References Cited

U.S. PATENT DOCUMENTS

D. 237,326 10/1975 Sims ..... 15/167 A
1,111,144 9/1914 Epstein et al. ..... 15/167 A

FOREIGN PATENT DOCUMENTS 710495 6/1965 Canada ..... 15/167 A
684809 3/1930 France ..... 15/167 A
169217 9/1921 United Kingdom ..... 15/167 A

*Primary Examiner*—Peter Feldman
*Attorney, Agent, or Firm*—Thomas I. Rozsa

[57] ABSTRACT

The present invention relates to an improved toothbrush which permits the user to brush both sides of his teeth at the same time. Through use of the Twin Dental Brush, the user can effectively brush the rear face of each tooth to thereby remove plaque and other unwanted matter from the rear face as well as the front face of the tooth. In addition to permitting effective and efficient cleaning of both sides of a tooth at the same time, the present invention enables the user to effectively clean and remove plaque in a very rapid manner.

3 Claims, 2 Drawing Figures

TWIN DENTAL BRUSH

BACKGROUND OF THE INVENTION

1. Field of the Invention

The present invention relates to an improved toothbrush which permits the user to brush both sides of a tooth at the same time. The present invention also incorporates a novel design for a toothbrush which facilitates more efficient cleaning of all parts of a tooth, including the spaces between teeth where food particles and other matter can become lodged. While primarily applicable for use with human beings, the design of the improved toothbrush can also be used on animals. Veterinarians can use this brush when cleaning the teeth of animals such as dogs or cats which have been sedated in order to permit this treatment.

2. Description of the Prior Art

In general, the conventional toothbrush is a well known instrument for cleaning and brushing human teeth. The brush consists of a handle, usually made of plastic-like material which contains a set of bristles at one end. The bristles or brush portion of the toothbrush are coated with toothpaste and used to brush the teeth clean. A major drawback in the conventional well known toothbrush is that an individual can only brush one side of his teeth at a given time. In theory, the individual could brush his teeth on one side, then reverse the brush and brush the inside of his teeth in a second operation. In fact, this is very seldom done. Most individuals are in a hurry in the morning and usually only brush the front side of their teeth.

Plaque is a film of mucus harboring bacteria on a tooth. Plaque forms on the tooth during the night while the individual is asleep. Brushing the front portion of the tooth removes the plaque from this side of the tooth. However, failure to brush the rear face of the tooth results in the plaque which has formed on the rear portion of the tooth remaining there. Other implements are useful for removing food particles and other debri from between teeth. One example is a water pick which shoots a jet of water between the teeth to facilitate dislodging the food particles which are impacted between teeth. A second example is dental floss which can be inserted between teeth to remove impacted food particles and also to remove plaque which has formed between teeth. Therefore, the conventional toothbrush is effective for removing plaque from the front side of the tooth and the water pick and dental floss are effective for removing matter and plaque from between teeth. However, neither is effective for removing plaque from the rear side of the tooth. As a result, the plaque continues to build up and harbor bacteria on the rear face of the tooth. This results in serious decay beginning on the rear face of the tooth which ultimately leads to cavities and in more serious situations to the entire loss of the diseased tooth.

There is no effective implement known in the prior art for effectively brushing the rear face of a tooth. As previously mentioned, in theory an individual could reverse the toothbrush after brushing the front side of his teeth and then brush the rear face of the teeth. In fact, this is seldom done because the individual is usually in a hurry to get to work in the morning when he brushes his teeth and additionally, trying to reverse a conventional toothbrush and use it to brush the inside surface of the teeth is an uncomfortable and awkward operation. As a result, either the rear side of the individual's teeth is not brushed at all or else it is only partially and ineffectively brushed through use of a conventional toothbrush.

SUMMARY OF THE PRESENT INVENTION

The present invention relates to an improved toothbrush which permits the user to brush both sides of his teeth at the same time. Through use of the Twin Dental Brush, the user can effectively brush the rear face of each tooth to thereby remove plaque and other unwanted matter from the rear face as well as the front face of the tooth. In addition to permitting effective and efficient cleaning of both sides of a tooth at the same time, the present invention enables the user to effectively clean and remove plaque in a very rapid manner.

It has been discovered, according to the present invention, that if a toothbrush is formed which contains a pair of handles which are joined at one end by a pivot or hinge like scissors to thereby resemble a pair of tongs and the open ends contain a pair of spaced parallel bristles or brushes, then the user can grasp the instrument at the pivoted end and place the instrument on either side of a tooth so that the front side of the tooth is brushed with one set of bristles while the rear face of the tooth is simultaneously brushed with the other set of bristles.

It has also been discovered, according to the present invention, that if the handles of the Twin Dental Brush are straight and extend in parallel planes from the point of pivot, then the Twin Dental Brush is extremely effective for simultaneously brushing the front and rear faces of the front teeth.

It has additionally been discovered, according to the present invention, that if the handles of Twin Dental Brush initially extend in parallel planes from the point of pivot and thereafter are offset at parallel angles from the initial handle position, then the Twin Dental Brush is extremely effective for simultaneously brushing the front and rear faces of the rear teeth. The offset angle also permits effective and efficient brushing of the spaces between adjoining teeth.

It is therefore an object of the present invention to provide a unique toothbrush which has oppositely facing bristles located in spaced apart parallel planes to each other to thereby enable the user to effectively and efficiently simultaneously brush the front and rear surfaces of his teeth.

It is another object of the present invention to provide a tool which can be used to effectively and efficiently brush the rear surface of teeth, an area which is frequently left unbrushed through use of prior art implements.

It is a further object of the present invention to provide a unique design for a dual bristled toothbrush which permits the user to efficiently and effectively clean both the front and rear faces of his front teeth simultaneously.

It is yet another object of the present invention to provide a unique design for a dual bristled toothbrush which permits the user to efficiently and effectively clean both the front and rear faces of his rear teeth and the spaces between his teeth simultaneously.

Further novel features and other objects of the present invention will become apparent from the following detailed description, discussion and the appended claims, taken in conjunction with the drawings.

DRAWING SUMMARY

Referring particularly to the drawings for the purpose of illustration only and not limitation there is illustrated:

DETAILED DESCRIPTION OF THE PREFERRED EMBODIMENT

Figure 1:
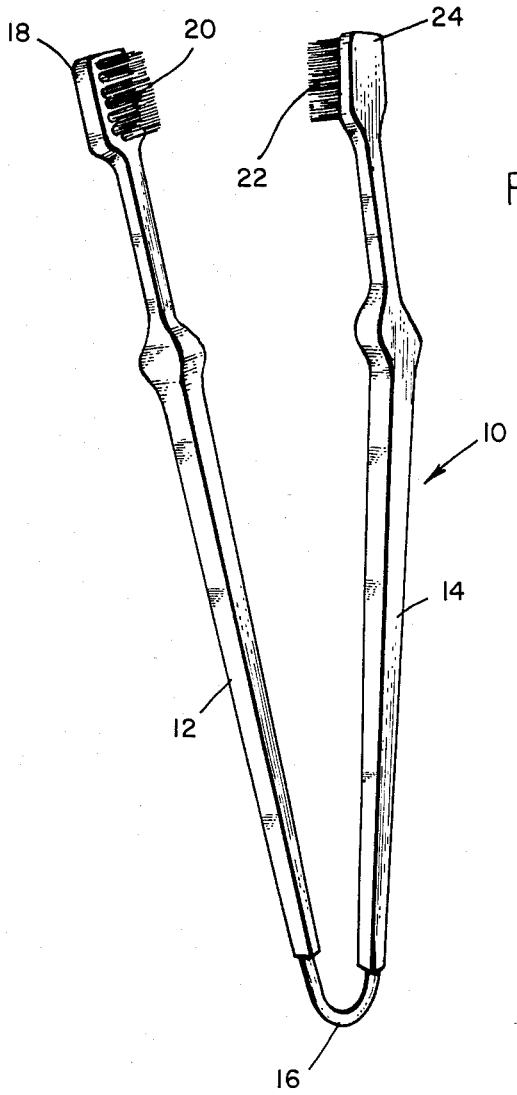
FIG. 1 is a perspective view of one embodiment of the present invention, in which the handles are straight and extending in parallel planes from the point of pivot.

Referring to the drawings of the present invention in detail and more particularly to FIG. 1, there is shown at 10 one embodiment of the present invention. The Twin Dental Brush 10 comprises a first straight elongated handle member 12 and a second straight elongated handle member 14. The first handle member 12 and the second handle member 14 are pivotally joined at one end by pivot means 16. The pivot means can be a metal wire. Alternatively, the entire assembly can be molded in one piece so that pivot means 16 is a curved flexible piece of material such as molded plastic. As shown in FIG. 1, first handle member 12 and second handle member 14 extend upwardly and outwardly from each other, in generally parallel planes. Adjacent its uppermost portion 18, first handle member 12 contains a first set of parallel bristles 20 which extend away from first handle member 12 and toward second handle member 14. Similarly, adjacent its uppermost portion 24, second handle member 14 contains a second set of parallel bristles 22 which extend away from second handle member 14 and toward first handle member 12. The first set of parallel bristles 20 and the second set of parallel bristles 22 are in generally spaced parallel relationship to one another such that they can be brought into direct alignment when the two handle members are presented together. In the preferred embodiment, the handle members are made of rigid material such as plastic while the pivot means 16 is flexible to thereby permit the two handle members to be brought towards each other.

In use, the first set of parallel bristles 20 and the second set of parallel bristles 22 are each coated with toothpaste or comparable tooth cleansing material and the Twin Dental Brush 10 is inserted into the individual's mouth such that the teeth to be cleaned are located between the two sets of parallel bristles 20 and 22 respectively. The individual moves the first elongated handle member 12 and the second elongated handle member 14 up and down and back and forth in a conventional toothbrushing manner. The individual also can move the two handle members toward or away from each other to apply more or less pressure against the surfaces of the teeth which are being cleaned. Through use of the present invention, the first set of parallel bristles 20 are used to clean the rear surface of the individual's teeth while the second set of parallel bristles 22 are used to clean the front surface of the individual's teeth. This can of course be reversed if desired. Through use of the present invention, both the front and rear surfaces of the individual's teeth can be cleaned simultaneously and plaque and other harmful material can thus be brushed away from both the front and rear faces of each tooth. The present invention is especially useful for cleaning the rear surface of the teeth which is frequently neglected.

The design on the Twin Dental Brush 10 shown in FIG. 1 is especially useful for cleaning the front set of teeth since the straight design of the two sets of handles 12 and 14 respectively easily facilitates brushing straight up and down which is the type of stroke most needed for the upper and lower front teeth. While this embodiment can also be used to brush the rear teeth, a more effective embodiment for the latter purpose is disclosed in FIG. 2.

Figure 2:
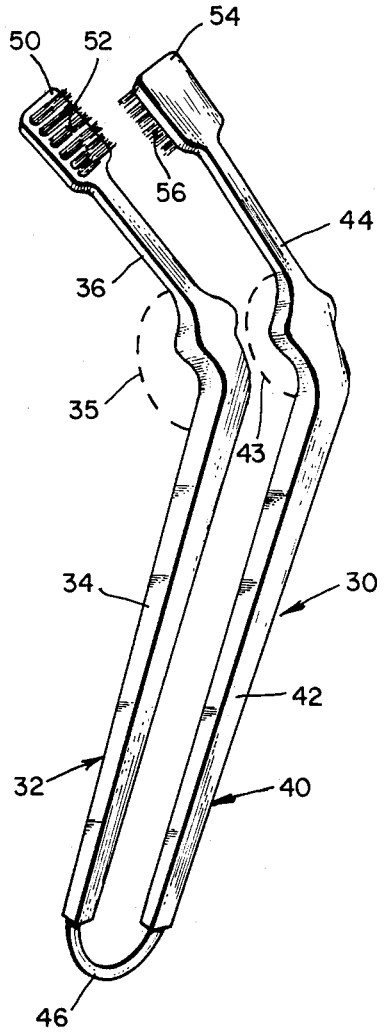
FIG. 2 is a perspective view of an alternative embodiment of the present invention, in which the handles initially extend in parallel planes from the point of pivot and thereafter are offset at parallel angles from the initial handle position.

Referring more particularly to FIG. 2, there is shown at 30 the second embodiment of the present invention. The Twin Dental Brush 30 contains a first handle member 32 which extends in a straight lengthwise fashion for a portion of its length and then extends at an angle to its initial direction for the balance of its length. Although of one piece construction, the first handle member 32 can be considered to be in two sections, a first lengthwise section 34 and a second offset section 36 which extends at a uniform angle 35 to first section 34.

The Twin Dental Brush 30 also contains a second handle member 40 which extends in a straight lengthwise fashion for a portion of its length and then extends at an angle to its initial direction for the balance of its length. As with the first handle member, the second handle member 40 is of one piece construction but can be considered to be in two sections, a first lengthwise section 42 and a second offset section 44 which extends at a uniform angle 43 to the first section 42. The lower portion of first section 34 and first section 42 are pivotally connected by flexible pivot means 46. As with the first embodiment 10, the flexible pivot means 46 can be a metal wire or else can be flexible plastic which is molded to the two handle members in a one piece construction. First handle section 34 extends in a generally spaced parallel relationship to first handle section 42. Similarly, second offset section 36 extends in a generally spaced parallel relationship to second offset section 44.

Adjacent its uppermost or farthest portion 50, first offset section 36 contains a first set of parallel bristles 52 which extend away from first offset section 36 and toward second offset section 44. Similarly, adjacent its uppermost portion 54, second offset section 44 contains a second set of parallel bristles 56 which extend away from second offset section 44 and toward first offset section 36. The first set of parallel bristles 52 and the second set of parallel bristles 56 are in generally spaced parallel relationship to one another such that they can be brought into direct alignment when the two handle members are pressed together. In the preferred embodiment, the two handle members are made of rigid material such as plastic while the pivot means 46 is flexible to thereby permit the two handle members 32 and 40 to be brought towards each other.

Referring more particularly to FIG. 2, the relative lengths and sizes of the toothbrush sections are clearly shown. The length of each offset section 36, 44 (each offset section including a slender elongated section and a tranversely wider, generally rectangular section 50, 54, respectively) is approximately half the length of each first section 34, 42. The slender elongated section of each offset section is approximately twice the length of each generally rectangular section 50, 54, respectively.

In use, the first set of parallel bristles 52 and the second set of parallel bristles 56 are each coated with toothpaste or comparable tooth cleansing material and the Twin Dental Brush 30 is inserted into the individual's mouth such that the teeth to be cleaned are located between the two parallel sets of parallel bristles 52 and 56 respectively. The special effectiveness of the alternative embodiment 30 is that the offset angle 35 and 43 respectively from the first to the second sections of each handle permits more effective cleaning in the rear teeth. The second embodiment 30 permits the user to reach further back into his mouth to thereby more effectively reach the rearmost teeth. Although any multiplicity of angles 35 or 43 is within the spirit and scope of the present invention, an angle 35 or 43 of approximately 135 degrees from the first section to the offset section is most effective. The individual moves the first handle member 32 and the second handle member 40 up and down and back and forth in a conventional toothbrushing manner. The individual also can move the two handle members toward or away from each other to apply more or less pressure against the surfaces of the teeth which are being cleaned. Through use of the present invention, the first set of parallel bristles 52 are used to clean the rear surface of the individual's teeth while the second set of parallel bristles 56 are used to clean the front surface of the individual's teeth. This can of course be reversed, if desired. Through use of the present invention, both the front and rear surfaces of the individual's teeth can be cleaned simultaneously and plaque and other harmful material can thus be brushed away from both the front and rear surfaces of each tooth. As with the first embodiment 10, the second embodiment 30, is especially useful for cleaning the rear surface of the teeth which is frequently neglected. The second embodiment 30 of the present invention is especially useful for cleaning the rear teeth since the offset angle 35 or 43 enables the user to reach further into his mouth and align the bristles 52 and 56 more effectively with the rear teeth.

While the present invention is intended primarily for use on human teeth, it is also capable of being used by veterinarians to clean animal teeth.

Of course, the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms of modification in which the invention might be embodied or operated.

The invention has been described in considerable detail in order to comply with the patent laws by providing a full public disclosure of at least one of its forms. However, such detailed description is not intended in any way to limit the broad features or principles of the invention, or the scope of patent monopoly to be grated.

What is claimed is:

1. A dental brush for simultaneously brushing both faces of a tooth comprising:

a. a first handle member;

b. said first handle member comprising a first straight section and a second offset section which extends from one end of the first straight section and at a uniform angle to the first straight section;

c. said second offset section of the first handle member further comprising a slender elongated section adjacent said first section at one end and a tranversely wider, generally rectangular section at the other end of the slender elongated section;

d. a second handle member;

e. said second handle member containing a first straight section and a second offset section which extends from one end of the first straight section and at a uniform angle to the first straight section;

f. said second offset section of the second handle member further comprising a slender elongated section adjacent said first section at one end and a tranversely wider, generally rectangular section at the other end of the slender elongated section;

g. said first handle member and said second handle member pivotally attached at the lower portion of each first section such that the two handle members extend upwardly and away from each other in generally spaced parallel planes;

h. the angle of the offset section to the first straight section of each handle member being the same such that the first straight section of each handle member extend away from each other in generally spaced parallel planes and the offset section of each handle member extend away from each other in generally spaced parallel planes so that the respective elongated sections are oppositely disposed and the respective wider sections are oppositely disposed;

i. said first handle member containing a first set of parallel bristles emanating from the wider, generally rectangular section of its offset section;

j. said first set of parallel bristles extending away from the wider rectangular section of the offset section of said first handle member and towards the wider rectangular section of the offset section of said second handle member;

k. said second handle member containing a second set of parallel bristles emanating from the wider, generally rectangular section of its offset section;

l. said second set of parallel bristles extending away from the wider rectangular section of the offset section of said second handle member and towards the wider rectangular section of the offset section of said first handle member;

m. said first set of parallel bristles and said second set of parallel bristles facing each other in generally spaced parallel relationship such that they can be brought into direct alignment when the two handle members are pressed together;

n. said second offset section of each handle member being approximately half the length of each of said first straight sections, said slender elongated section of each handle member being approximately twice the length of each of said generally rectangular sections; and o. wherein the angle between each straight section and its offset section on each handle is approximately 135 degrees.

2. The invention as defined in claim 1 wherein said flexible pivot means is flexible molded plastic which is fixedly attached onto the respective first section of said first and second handle members.

3. The invention as defined in claim 1 wherein said first and second handle members are made of plastic.

* * * * *